US005274708A

United States Patent [19]

Fields et al.

[11] Patent Number: 5,274,708

[45] Date of Patent: Dec. 28, 1993

[54] DIGITAL STEREO SOUND ENHANCEMENT UNIT AND METHOD

[75] Inventors: Craig D. Fields, Wheeling; John M. Brooks, Itasca, both of Ill.

[73] Assignee: Fusan Labs, Inc., Arlington Heights, Ill.

[21] Appl. No.: 890,762

[22] Filed: Jun. 1, 1992

[51] Int. Cl.[5] ..... H04S 1/00

[52] U.S. Cl. ..... 381/1; 381/17

[58] Field of Search ..... 381/1, 17, 28, 18, 61, 381/63, 97

[56] References Cited

U.S. PATENT DOCUMENTS

| | | | |
|---|---|---|---|
| 3,156,769 | 11/1964 | Markowitz . | |
| 3,560,656 | 2/1971 | Gilbert . | |
| 3,670,106 | 6/1972 | Orban . | |
| 3,911,776 | 10/1975 | Beigel . | |
| 3,980,964 | 9/1976 | Grodinsky | 330/29 |
| 3,989,897 | 11/1976 | Carver . | |
| 4,024,344 | 5/1977 | Dolby et al. . | |
| 4,218,585 | 8/1980 | Carver . | |
| 4,239,939 | 12/1980 | Griffis . | |
| 4,308,424 | 12/1981 | Bice, Jr. . | |
| 4,309,570 | 1/1982 | Carver . | |
| 4,489,432 | 12/1984 | Polk | 381/1 |
| 4,555,795 | 11/1985 | Bedini | 381/17 |
| 4,748,669 | 5/1988 | Klayman | 381/1 |
| 4,837,824 | 6/1989 | Orban | 381/1 |
| 4,866,774 | 9/1989 | Klayman | 381/1 |
| 4,910,778 | 3/1990 | Barton | 381/1 |
| 4,980,914 | 12/1990 | Kunungi et al. | 381/1 |
| 5,119,420 | 6/1992 | Kato et al. | 381/1 |

FOREIGN PATENT DOCUMENTS

PCT/US90/-
00507 8/1990 European Pat. Off. .

*Primary Examiner*—Forester W. Isen
*Attorney, Agent, or Firm*—Arnold, White & Durkee

[57] ABSTRACT

A method and apparatus for processing digital stereo signals in a stereo system having a left and right channel in which digital information corresponding to the left and right channels is read from a source of digital information. The left and right channels of information are duplicated and various duplicated signals are processed by predetermined functions. The duplicated signals are manipulated by a plurality of user-defined functions to form a space signal, which is combined with other signals to form left and right output signals.

30 Claims, 4 Drawing Sheets

DIGITAL STEREO SOUND ENHANCEMENT UNIT AND METHOD

FIELD OF THE INVENTION

The present invention relates generally to electronic sound enhancement and more particularly to a digital system for expanding the sound quality of stereophonic signals.

BACKGROUND OF THE INVENTION

Conventional stereo systems are designed to improve the sound quality of audio recordings by giving a more realistic feel than mono recordings. This is accomplished by employing a LEFT and a RIGHT channel having different recorded components. When the LEFT and RIGHT channels are played simultaneously over different speakers, the separation between the speakers producing the LEFT and RIGHT channels gives the listener the impression that the sound produced is live rather than recorded. Many listeners prefer the sound quality of stereo recordings to mono recordings.

As technology continues to expand, audio enthusiasts seek additional sound enhancements that render listening to music even more realistic and enjoyable. Because each listener has individual tastes regarding the qualities he finds enjoyable in recorded music, a particular stereo recording may produce a sound quality that appeals to some listeners but not to others. A stereo sound enhancement system for providing stereo sound that may be adjusted to the tastes of individual listeners is desirable.

Additionally, professional recording engineers continuously seek improved methods of obtaining new and unique sound qualities in their recordings. They also seek to simplify methods of obtaining known effects, such as placing certain components of a recording in either the LEFT or RIGHT channel of a stereo recording or producing the effect of moving the certain parts of the music to give the appearance that they are emanating from different locations (for example, in front of or behind) relative to the unaltered signal.

SUMMARY OF THE INVENTION

Accordingly, it is an object of the invention to provide a stereo enhancement unit that may be controlled by an individual listener, to produce a sound quality that is desirable and pleasant to that listener.

It is a more specific object of the invention to provide such a stereo enhancement unit that may be used by recording professionals to enhance the sound characteristics of their recordings.

It is another object of the invention to provide such a stereo enhancement unit that operates on digital information.

It is still another object of the invention to provide such a stereo enhancement unit that produces a center image effect, a movement effect and a space effect.

Other aspects and features of the present invention will be pointed out specifically in the following specification and accompanying drawings or will be apparent therefrom.

The present invention is a digital stereo enhancement unit that produces three principal effects: a center image effect, a movement effect and a space effect. These effects are produced by a combination of digital data manipulation circuits having predetermined characteristics and other data manipulation circuits that have user-controllable outputs. Contemplated user controls range in complexity from simple adjustments of the gain output by some circuits to more complicated circuitry and equations that are functions of multi-dimensional inputs. Thus, individual users of the system of the present invention have the capability of customizing the output of their stereo systems by selecting different combinations of center image, movement and space to obtain a pleasing output. Unlike prior-art systems, the present invention treats the user interface with more contemplation. The user controls affect not only the static behavior of the system (the sound quality when user-controls are fixed), but the controls affect the dynamical relationship between the sound enhancement system and the user. The present invention emphasizes the importance of providing both static effects and pleasing dynamical control because dynamic control affects what the listener hears.

In a preferred embodiment of the present invention, digital information corresponding to LEFT and RIGHT stereo signals are read from a conventional source such as a compact disk ("CD") or digital audio tape ("DAT") or digital converter. The LEFT and RIGHT channels are copied several times. The copied signals can be operated on separately by various combinations of the predetermined functions and user controls to add specific effect characteristics. After the signals are modified, they are recombined to form a LEFT and RIGHT output channel.

Figure 1:
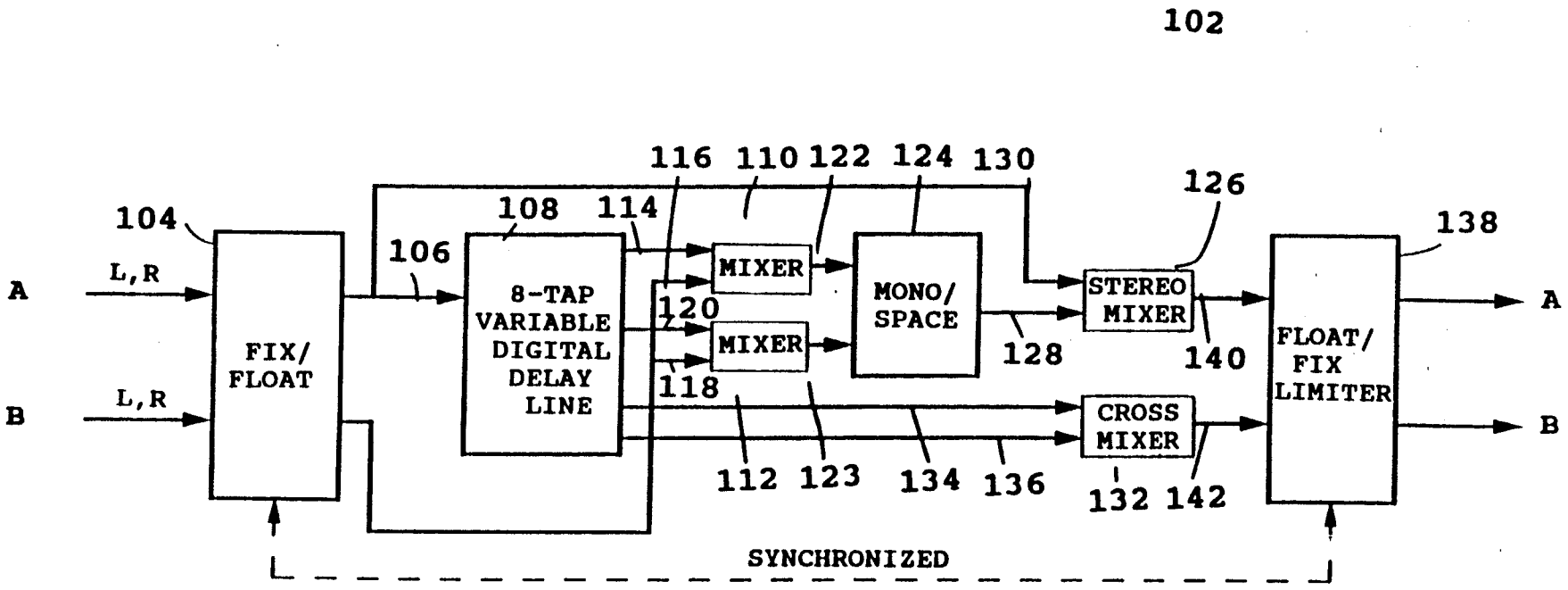
FIG. 1 is a functional block diagram of the stereo enhancement unit of the present invention.

While the invention is susceptible to varius modifications and alternative forms, a specific embodiment thereof has been shown by way of example in the drawings and will herein be described in detail. It should be understood, however, that the invention is not intended to be limited to the particular form disclosed. On the contrary, the applicant's intention is to cover all modifications, equivalents, and alternatives falling within the spirit and scope of the invention as defined by the appended claims.

DETAILED DESCRIPTION OF A PREFERRED EMBODIMENT

The present invention is a digital stereo enhancement unit that produces three principal effects: a center image effect, a movement effect and a space effect. These effects are produced by a combination of digital data manipulation circuits having predetermined characteristics, such as gain, and other data manipulation circuits that have user-controllable output. Contemplated user-controllable outputs range in complexity from simple adjustments of the gain output by some circuits to complex equations that must be programmed by the user. Thus, individual users of the system of the present invention have the capability of customizing the output of their stereo systems by selecting different combinations of center image, movement and space to obtain a pleasing output.

The center image effect is created by combining duplicated LEFT and RIGHT channels of the stereo signal input, multiplying this signal by a user-controllable gain and recombining the resultant with the outputs from other effect circuits. Center image is particularly useful for giving the effect of moving certain signal components of the stereo recording (for example, the voice track) forward or backward with respect to their position on the unprocessed recording.

The movement effect is created by combining various mono-like signal components and allowing them to be multiplied by various user-defined functions and recombined in user-controlled proportions. This function is useful in giving the effect that a particular component of a signal is moving between the LEFT and RIGHT channels.

The space effect creates ambient information by generating signal components from the duplicated LEFT and RIGHT signals. These ambient signals can be added into the output signal. The space function adds ambience to the output signal to modify its character. The space effect may be used to give the appearance that the recording was made in a small practice room with baffled walls or in a large auditorium. As will be fully described hereinafter, the use of a digital delay having resolution in the microsecond range allows the user to widen the effect of ambient information. Delays in the range of 10 microseconds to 1000 microseconds have been found to produce significant desirable effects on the sound quality of processed signals.

The center image and space function may be generally thought of as having a loosely defined inverse relationship to each other. For example, when a speaker is talking in close proximity to a listener, the listener tends to block out features of the ambient sense of the room and concentrate on the voice of the speaker. When the speaker is far away in a large room, the ambient qualities of the room are more significant in forming the quality of sound heard by the listener. Similarly, the center image function of the present invention has the effect of moving components of a recording closer to or farther away from the listener. It is within the contemplation of the present invention for the predetermined functional operations performed by the present invention (for example, the gain of various multiplying nodes) to de-emphasize the effect of space ambient information as center image is increased and vice versa. Additionally, it is within the contemplation of the present invention to perform this effect while minimizing the effect of increased volume that would naturally occur when a signal component is moved forward through the use of the center image effect. Thus, the relationship between the space effect and the center image effect is perceptible without the additional complication of increased gain of the center image information.

Referring to the drawings, FIG. 1 is a functional block diagram of a digital stereo enhancement unit 102 according to the present invention. Two pairs of digital stereo inputs A and B, each consisting of a LEFT and RIGHT channel L and R, are fed into a fix/float input buffer 104, which converts fixed point integer digital data from a source of digital information (for example, a CD or a DAT) into floating point format. The A channels are defined to be main channels and the B channels are defined to be auxiliary channels. The A channels are each duplicated as many times as desired by conventional techniques and fed via a path 106 into a variable digital delay 108. As will be apparent to one of ordinary skill in the field, signals may be duplicated in a digital embodiment of the present invention by repeatedly reading a value from a memory location or any other conventional means. In an analog implementation of the present invention, signals may be duplicated by using a single signal source as the input to a plurality of circuits or by any other conventional means.

In the illustrated embodiment, the LEFT and RIGHT A channels are each duplicated 4 times, requiring a total of 8 input lines into the variable digital delay 108. As will be fully described hereinafter, the use of multiple copies of signals allows the stereo enhancement unit of the present invention to operate on each each signal copy separately. The signal copies may be recombined after modification in a variety of ways to allow greater flexibility in creating the desired type of output signal.

The digital delay 108 may delay each input by a different user-defined time period ranging from zero to tens of milliseconds with resolution of a few microseconds (a single digital sample period). Each of the signal copies previously described may be delayed by any number of digital sample periods. For example, if the digital delay 108 stores 1,024 samples, any or all of the signal copies may be delayed by any amount in the range of zero to 1,023 samples before being recombined to form the output signal. Each of the signal copies may be delayed by half a digital sample by employing a two-times oversampling filter on the signal 106 and using 108 to store the data based on twice the sampling rate. The range of the delay has been cut in half, but the resolution has been doubled. The delayed signals exiting 108 would be decimated by a factor of two before being passed on to the rest of the audio processing running at one-times sampling rate. The resolution could be doubled again by using a quad-oversampling filter and so on. Doing the oversampling before the delay buffer saves 75% of the processing required if it were done on the four stereo pairs leaving the delay block 108. It is within the contemplation of the present invention for the delay length induced by the respective RIGHT and LEFT digital delay circuits to be controllable by a user of the system. By allowing independent user control of the delay time for the RIGHT and LEFT signals, the stereo enhancement circuit 124 provides the user with flexibility to produce a sound quality desirable to him.

The use of delays with resolution in the range of a few microseconds is an important feature of the present invention. Such resolution allows the system user to exercise great control over the mixing of signals. For example, the delay of main channel signals used to create the space effect can be carefully proportioned with respect to the delay of main channel signals used to create the mono effects, and vice versa. Similarly, any combination of proportional delay between the mono effect signals and the space effect signals may be employed in conjunction with independently adjusted left and right main channel signals. Variable stereo channel delays of the main stereo channel A can be provided to the cross-mixer and sent out via the auxiliary output B. Finally, the auxiliary input B can be combined with a variable delayed portion of the main channel input to achieve "sound on sound effects." It should be noted that the auxiliary input B could be derived from an independent stereo source or by the auxiliary output B itself.

The effect on the sound produced by the stereo enhancement system of the present invention is dramatically impacted by the use of digital delays having a resolution in the range of a few microseconds. Previously known stereo enhancement systems have supported the use of delays with resolutions only as small the millisecond range because smaller resolution has no noticeable effect on the output of these systems. However, the present invention allows close control of the proportional delay between signal components, allowing noticeable effects to be produced with delays having resolution in the microsecond range. This feature is useful for left/right time alignment. Both mono effect signals and space effect signals can be brought into or out of time coincidence independently as required or for a desired effect.

The outputs from the digital delay 108 are fed into a pair of mixers 110 and 112. A predetermined number of delay line outputs (for example, four) are fed into the mixer 110 via a path 114. The B signals are fed into the mixer 110 directly from the fix/float input buffer 104 via a path 116. Additionally, the B signals are fed directly from the fix/float input buffer 104 directly, into the mixer 112 via a path 118. A predetermined number of delay line outputs (for example, four) are also fed from the delay 108 into the mixer 112 via a path 120. The mixer 110 adds its input signals together and feeds the resultant output via a path 122 to space circuitry in a mono/space stereo enhancement circuit 124. The mixer 112 adds its input signals together and feeds the resultant output via a path 123 to mono circuitry in the mono/space stereo enhancement circuit 124.

The output of the mono/space stereo enhancement circuit 124 is fed into a stereo mixer 126 directly from the fix/float input buffer 104 via a path 130. The stereo mixer 126 adds the LEFT output of the mono/space stereo enhancement circuit 124 to the LEFT A output of the fix/float input buffer 104. Similarly, the stereo mixer 126 adds the RIGHT output of the mono/space stereo enhancement circuit 124 to the RIGHT A output of the fix/float input buffer 104.

A cross mixer 132 is employed to create a mono signal from stereo input signals. The cross mixer 132 receives input from the variable digital delay 108 via paths 134 and 136. The LEFT A signal is added to the RIGHT A signal to form a cross-mixed LEFT signal. Similarly, the RIGHT A signal is added to the LEFT A signal to form a cross-mixed RIGHT signal.

The output of the stereo mixer 126 is fed into a float/-fix output buffer 138 via a path 140. The output of the cross mixer 132 is fed into the float/fix output buffer 138 via a path 142. The float/fix output buffer 138 converts the floating point digital information into fixed point integers, limiting the output to the desired dynamic range, and passes this information downstream to an amplifier circuit (not shown) where it may be played on conventional stereo speakers.

Figure 2:
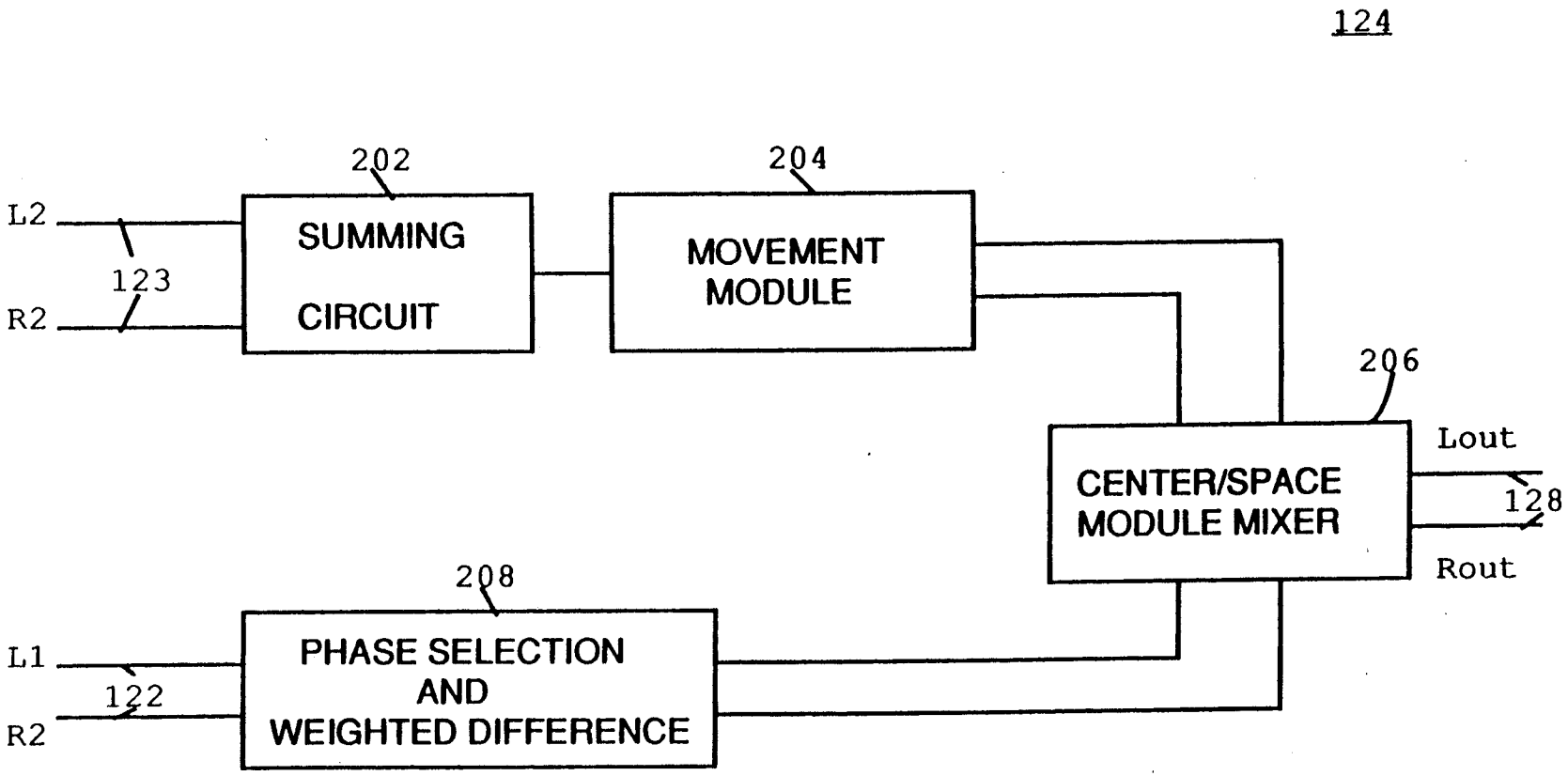
FIG. 2 is a functional block diagram of the mono/space circuitry shown in FIG. 1.

FIG. 2 is a block diagram of the mono/space stereo enhancement circuit 124. Stereo signals $L_2$ and $R_2$ are fed from the mixer 112 is fed into a mono summing circuit 202 via the paths 123 where a mono signal is formed by adding the LEFT channel to the RIGHT channel. The output of the summing circuit 202 is fed into a movement module 204, the operation of which is fully described hereinafter with reference to FIG. 3. The output of the movement module is fed into a center/space module mixer 206. The summing circuit 202 and movement module 204 are used to create the center image and movement effects.

Stereo signals $L_1$ and $R_1$ are fed via the paths 122 into a phase selection and weighted difference circuit 208, which is associated with the center/space module mixer 206, creates the space effect. The phase selection and weighted difference circuit 208 forms the ambient quality of the digital information being processed.

Ambient information is formed by creating a new LEFT output channel of information according to the formula $La=L_1*H_1(w)+R_1*H_2(w)$ where La is the left ambient signal, $L_1$ is the left ambient input signal, $H_1(w)$ represents a filter and phase selection filter for in phase signals, $R_1$ is the right ambient input signal and $H_2(w)$ represents a filter and phase selection filter for out of phase signals. The relative gains of $H_1(w)$ and $H_2(w)$ can give rise to signal gain and a weighted difference between left and right to create different effects. Similarly, a new RIGHT output channel is created according to the formula $R_a=R_1\ H_1(w)+L_1*H_2(w)$, where $R_a$ is the right ambient signal, $R_1$ is the right ambient input $H_1(w)$ represents a filter and phase selection filter for in phase signals, $L_1$ is the left ambient input signal and $H_2(w)$ represents a filter and phase selection filter for out of phase signals. Thus, the space effect is created by combining user-controlled proportions of various duplicated signals to form LEFT and RIGHT output signals. The output signals from the phase selection and weighted difference circuit 208 are fed into the center/space module mixer 206, which mixes these signals with the output signals from the movement module 204 to form the output from the mono/space stereo enhancement circuit 124.

The center/space module mixer 206 is also used to combine the center image signals with the ambient information signals. When the mono signal information from the movement module 204 is mixed with the output of the phase selection and weighted difference circuit 208, a user control may be employed to increase or decrease the proportion of mono information in the left and right signal. This feature allows manipulation of the signals to give the effect of forward or backward movement of one channel of information. The center image feature is particularly useful in moving the voice track of a conventional stereo recording forward or backward, because the voice track is typically recorded on a single channel. Another user control can be employed to increase or decrease the proportion of the mono type signal in the left verses the right output signals. This feature allows the effect of lateral movement. This lateral movement is useful in moving mono type signals such as vocals from side to side.

Figure 3:
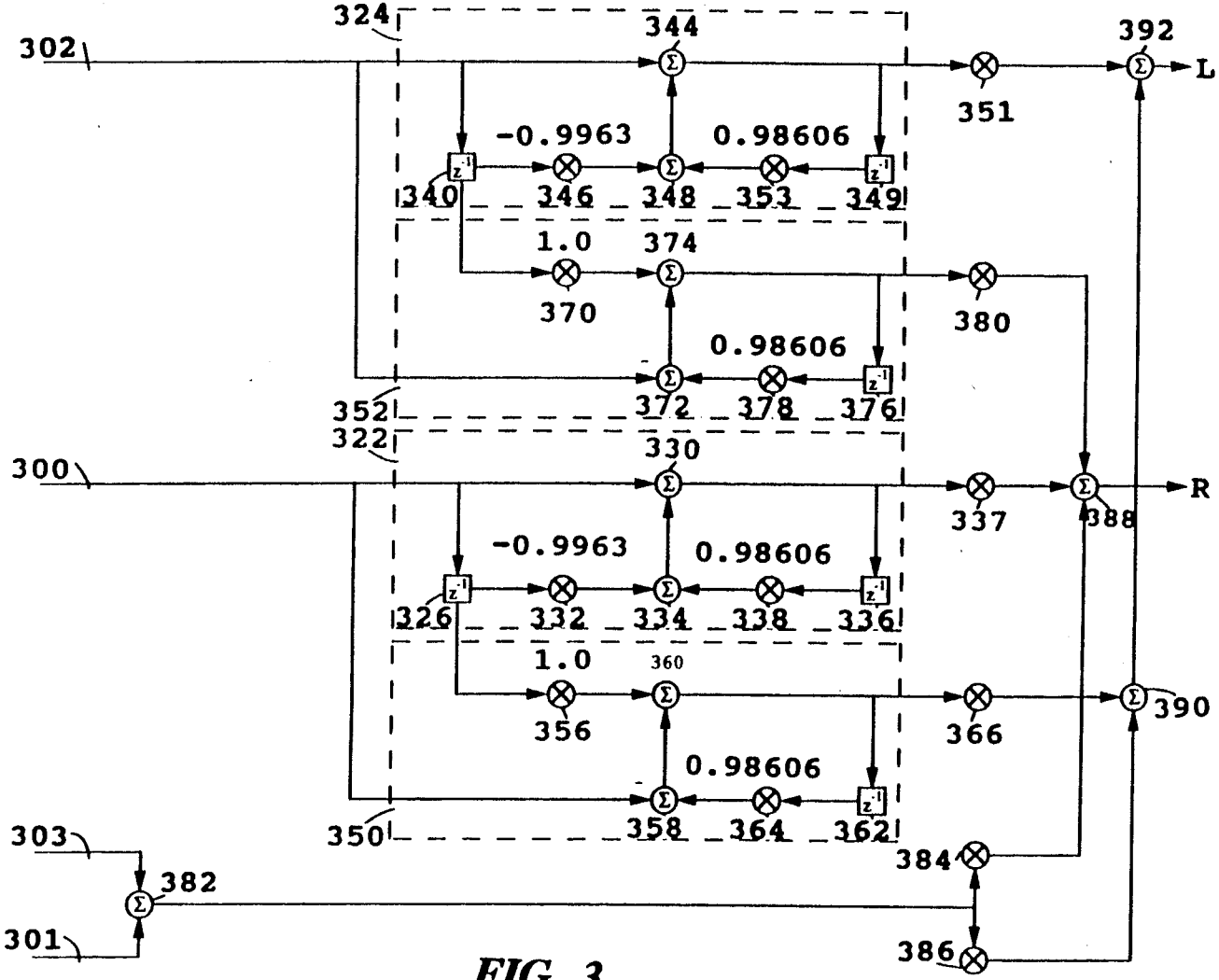
FIG. 3 is an expanded circuit diagram of the mono/space circuitry shown in FIG. 1.
Figure 4A:
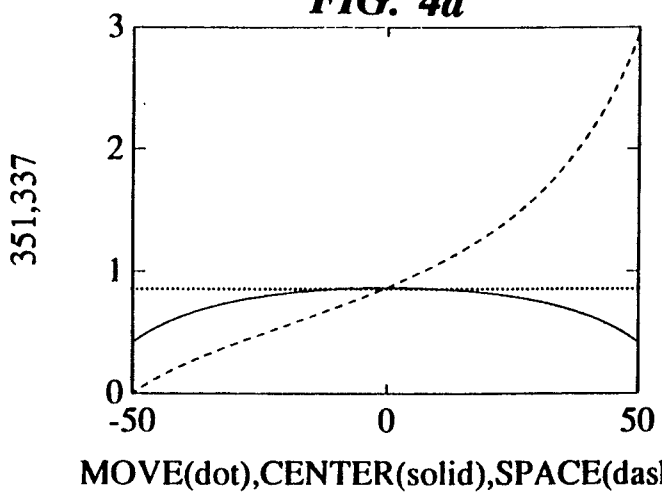
FIGS. 4A–4D are a graphic representation showing various relationships between user-controlled parameters in the stereo enhancement unit of the present invention.
Figure 4B:
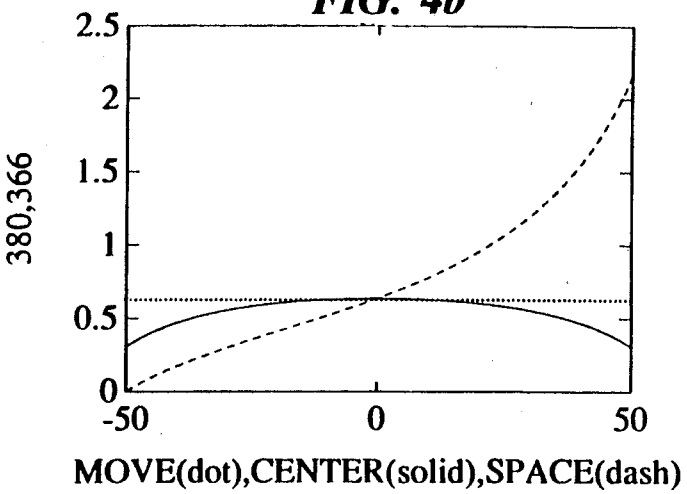
Figure 4C:
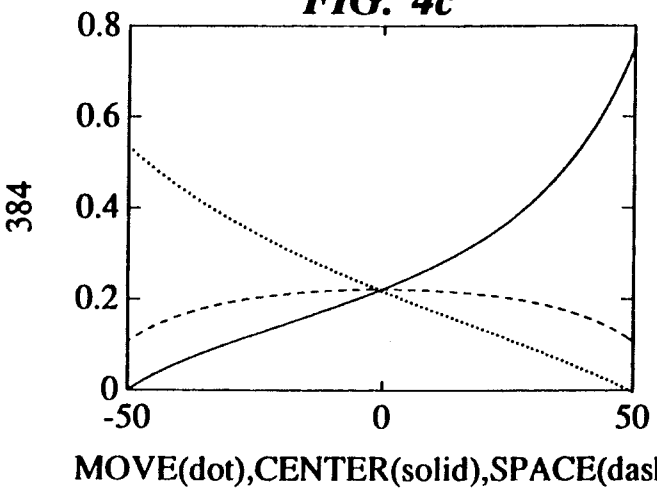
Figure 4D:
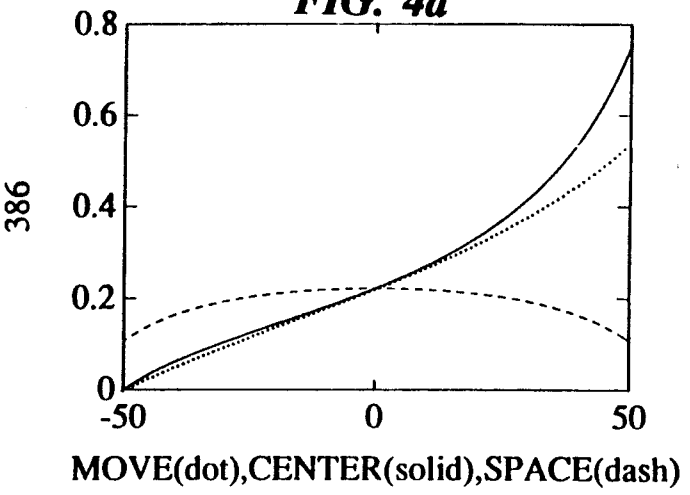

FIG. 3 is an expanded circuit diagram of the mono/space circuitry shown in FIG. 1. A RIGHT signal enters the stereo enhancement circuit 124 via a line 300 and a LEFT signal enters via a line 302. The RIGHT and LEFT signals are filtered by filters 322 and 324, respectively. In the RIGHT filter 322, the RIGHT signal is fed simultaneously into a filter element 326 and a summing node 330. The output of the filter element 326 is fed into a multiplying node 332, which has a predetermined gain. The output of the multiplying node 332 is fed into a summing node 334. The output of the summing node 330 is fed into a filter element 336 as well as a multiplying node 337, which has a user-defined gain. The output of the filter element 336 is fed into a multiplying node 338, the output of which is fed as a second input into the summing node 334. The output of the summing node 334 is fed as a second input into the summing node 330.

Similarly, in the LEFT filter 324, the LEFT signal is fed simultaneously into a filter element 340 and a summing node 344. The output of the filter element 340 is fed into a multiplying node 346, which has a predetermined gain. The output of the multiplying node 346 is fed into a summing node 348. The output of the summing node 344 is fed into a filter element 349 as well as a multiplying node 351 having a user-defined gain. The output of the filter element 349 is fed into a multiplying node 353, the output of which is fed as a second input into the summing node 348. The output of the summing node 348 is fed as a second input into the summing node 344.

The filters 322, 324 are essentially high-pass filters that de-emphasize very low-frequency components in the range of 40 to 120 Hz. Thus, the filter 322 outputs the RIGHT input signal with low-frequency components de-emphasized, while the filter 324 outputs the LEFT input signal with low-frequency components de-emphasized.

The RIGHT signal and LEFT signal are fed via the lines 300 and 302 into high pass filters 350, 352, respectively. The output from the filter element 326 is fed into a multiplying node 356, which has a predetermined gain. The RIGHT signal is also fed into a summing node 358, which feeds its output into a summing node 360. The output of the multiplying node 356 is also fed into the summing node 360. The output of the summing node 360 is fed into a filter element 362 and the output of the filter element 362 is fed into a multiplying node 364, which has a predetermined gain. The output of the multiplying node 364 is fed as a second input into the summing node 358. The output of the summing node 360 is fed into a multiplying node 366, which has a user-defined gain.

Similarly, the output from the filter element 340 is fed into a multiplying node 370, which has a predetermined gain. The RIGHT signal is also fed into a summing node 372, which feeds its output into a summing node 374. The output of the multiplying node 370 is also fed into the summing node 374. The output of the summing node 374 is fed into a filter element 376 and the output of the filter element 376 is fed into a multiplying node 378, which has a predetermined gain. The output of the multiplying node 378 is fed as a second input into the summing node 372. The output of the summing node 374 is fed into a multiplying node 380, which has a user-defined gain.

The high pass filters 350, 352 de-emphasize very low-frequency components. Thus, the filter 322 outputs a −RIGHT signal with low-frequency components de-emphasized and the filter 324 outputs a −LEFT signal with low-frequency components de-emphasized.

The RIGHT input 301 and the LEFT input 303 are combined by a summing node 382 to form mono information, which is used to formulate enhanced sound effects. The mono output from the summing node 382 is duplicated and fed into a multiplying node 384 and a multiplying node 386, each of which has a user-defined gain. The output of the three user-controlled multiplying nodes 337, 380 and 384 are combined by a summing node 388. The output of the user-controlled multiplying nodes 366 and 386 are combined by a summing node 390 and the outputs of the user-controlled multiplying nodes 351 and 390 are combined by a summing node 392. Finally, the output of the summing node 388 is provided as the RIGHT output from the stereo enhancement unit 124 and the output of the summing node 392 is provided as the LEFT output from the stereo enhancement unit 124. Thus, mono information is recombined with both the RIGHT and LEFT signal after being processed by user defined functions. As previously noted, the user-controllable multiplying nodes 337, 351, 366, 380, 384 and 386 can produce output ranging in complexity from modification of the signal gain to user-defined mathematical functions that must be programmed by the user of the system. The outputs of these nodes constitute the user-controllable parameters that define the amount of space, center image, and movement imparted to the stereo signals input into the digital stereo enhancement unit 102 of the present invention.

As will be apparent to one of ordinary skill in the field after considering the foregoing, the summing node 388, which sums the component signals of the RIGHT output signal. In more general terms, the RIGHT channel output becomes mono processed information plus RIGHT-dominant ambient information. Similarly, the summing node 392 sums the component signals of the LEFT output signal. More generally LEFT channel output becomes mono processed information plus LEFT-dominant ambient information.

The filter circuits 322, 324, 350 and 352 are generally referred to as space circuitry. The user-controlled functions represented by the multiplying nodes 337, 351, 366, 380, 384 and 386 are generally referred to as the controls for center image and movement. The summing nodes perform the function of mixing signals. Additionally, the filter circuits 322, 324, 350 and 352 de-emphasize low frequency components in the RIGHT and LEFT signals. This means that low-frequency components are not processed by the space circuitry to prevent the bottom end of the frequency spectrum of music being processed from being cancelled out through the phase processing and mixing operations of the present invention.

FIG. 4 is a graphical representation of the effects of varying a specific set of user-defined controls for space, movement and center image via the multiplying nodes 337, 351,366, 380, 384 and 386.

It will be appreciated by those of ordinary skill in the field that the definition of specific equations governing the output of the user controls is largely a matter of aesthetics. The equations may represent the digital embodiment of a hardware model. In other words, the equations may be derived using mathematical and/or empirical techniques from an analog circuit network to yield a system of interleaved equations that can be implemented in digital form. The hardware model from which the equations are derived is generally created empirically to provide an aesthetically pleasing output. Other factors that influence the development of the analog circuitry are minimization of cost and optimization of sound quality.

Several design tradeoffs must be considered in designing the user control functions for the stereo enhancement unit of the present invention. Goals to be considered in achieving the best sonic quality (which is largely a subjective assessment by professionals in the field) involve minimizing the coloration and distortion of the music. Cost reduction is also an important consideration. Savings can be achieved by closely relating the algorithms of the user controls to both the analog and digital implementations of the present invention. In some cases, choices made in favor of sonic quality will adversely impact the cost of a given implementation.

Aesthetical factors also play an important role in designing the user controls. An optimal design includes sufficient controls to allow the user to shape the music but too many controls may confuse the user. While attempting to meet all these considerations, consistency must be established across all implementations of the present invention. Consistency is essential to the development of a central user base. Finally, typical engineering considerations (such as power supply voltage limitations for analog implementations or dynamic range considerations for digital implementations) apply to the development of effective user controls.

FIG. 4 shows the outputs of the user-controlled multiplying nodes 337, 351, 366, 380, 384 and 386. These node parameters are a function of the three variables: MOVE, CENTER and SPACE. The output of the multiplying nodes 337, 351, 366, 380, 384 and 386 show examples of one set of user-defined functions. As will be apparent to those of ordinary skill in the field, any number of user-defined functions may be implemented without departing from the scope of the present invention.

The dotted lines represent the node output as MOVE is swept from normalized numerical values ranging from −50 to 50 with CENTER and SPACE held at zero. The solid lines represent the node output as CENTER is swept from normalized numerical values ranging from −50 to 50 with MOVE and SPACE held at zero. The dashed lines represent the node output as SPACE is swept from normalized numerical values ranging from −50 to 50 with CENTER and MOVE held at zero. All of the curves intersect at MOVE=-SPACE=CENTER=zero. The node value at this position is referred to as the "detent" position N(0,0,0).

To obtain the node output when more than one of the three variables differs from zero, the following set of equations may be applied:

Assume that node output N is a function of MOVE, CENTER and SPACE identified as N(M,C,S). Additionally, assume that a MOVE curve is defined as $N_m(M)$ where CENTER and SPACE are equal to zero, a CENTER curve is defined as $N_c(C)$ where MOVE and SPACE are equal to zero and a SPACE curve is defined as $N_s(S)$ where MOVE and CENTER are equal to zero. Under these conditions:

$$N(M,C,S) = N(0,0,0) * \frac{N_m(M)}{N(0,0,0)} * \frac{N_c(C)}{N(0,0,0)} * \frac{N_s(S)}{N(0,0,0)}$$

Thus, their has been described herein a digital stereo sound enhancement unit and method. It will be understood that various changes in the details and arrangements of the implementation described herein will occur to those skilled in the art without departing from the principle and scope of the present invention. While the invention has been described with reference to the presently contemplated best mode for its practice, it is intended that this invention only be limited by the scope of the appended claims.

What is claimed is:

1. A method of processing digital signals in a stereo system having a left and a right channel, each of said left and right channels having an input signal and an output signal associated therewith, said method comprising the steps of:

reading information corresponding to each of said left and right signals from a source of audio information;

duplicating each of said left and right signals a predetermined number of times to create a plurality of duplicated left signals and a plurality of duplicated right signals;

manipulating at least one of said duplicated left signals with a first user-defined function to form a first left intermediate space signal;

manipulating at least one of said duplicated right signals with a second user-defined function to form a first right intermediate space signal;

combining said first left intermediate space signal with said first right intermediate space signal to form a left space signal;

manipulating at least one of said duplicated right signals with a third user-defined function to form a second right intermediate space signal;

manipulating at least one of said duplicated left signals with a fourth user-defined function to form a second left intermediate space signal;

combining said second right intermediate space signal with said second left intermediate space signal to form a right space signal;

creating a plurality of mono signal components;

multiplying said mono signal components by at least one user-defined function;

combining said mono signal components in user-defined proportions to form a movement signal;

combining said movement signal with at least one of said right space signal and said left space signal; and combining each of said left space and said right space signals with at least one other of said duplicated right signals and duplicated left signals to form said right and left output signals.

2. The method of processing signals of claim 1, further comprising the step of manipulating said at least one other of said duplicated signals with a fifth user-defined function.

3. The method of processing signals of claim 1, further comprising the step of delaying at least one of said duplicated left signals with respect to at least one of said duplicated right signals.

4. The method of processing signals of claim 3 wherein the delay between the at least one of said duplicated left signals and the at least one of said duplicated right signals is in the microsecond range.

5. The method of processing signals of claim 3 wherein the delay between the at least one of said duplicated left signals and the at least one of said duplicated right signals is in the range of 10 microseconds and 1000 microseconds.

6. The method of processing signals of claim 1, further comprising the step of delaying at least one of said duplicated right signals with respect to at least one of said duplicated left signals.

7. The method of processing signals of claim 6 wherein the delay between the at least one of said duplicated right signals and the at least one of said duplicated left signals is in the microsecond range.

8. The method of processing signals of claim 6 wherein the delay between the at least one of said duplicated right signals and the at least one of said duplicated left signals is in the range of 10 microseconds and 1000 microseconds.

9. The method of claim 1, wherein said right space signal is designated as $R_a$, and is created according to the formula:

$$R_a = R_1 * H_1(W) + L_1 * H_2(W)$$

where $R_1$ corresponds to at least one of said duplicated right signals;

$L_1$ corresponds to at least one of said duplicated left signals;

$H_1(W)$ represents a filter and phase selection filter for in phase signals; and $H_2(W)$ represents a filter and phase selection filter for out of phase signals.

10. The method of processing signals of claim 1, further comprising the steps of:

combining at least one of said duplicated left signals with at least one of said duplicated right signals to form an intermediate center image signal;

multiplying said intermediate center image signal by a user-defined function;

combining said intermediate center image signal with at least one of said right intermediate signal and said left intermediate signal to form said right output signal and said left output signal.

11. The method of claim 1, wherein said left space signal is designated as $L_a$, and is created according to the formula:

$$L_a = L_1 * H_1(W) + R_1 * H_2(W)$$

where $L_1$ corresponds to at least one of said duplicated left signals;

$R_1$ corresponds to at least one of said duplicated right signals;

$H_1(W)$ represents a filter and phase selection filter for in phase signals; and $H_2(W)$ represents a filter and phase selection filter for out of phase signals.

12. An apparatus for processing signals in a stereo system having a left and a right channel, each of said left and right channels having an input signal and an output signal associated therewith, comprising:

means for reading information corresponding to each of said left and right signals from a source of audio information;

means for duplicating each of said left and right signals a predetermined number of times to create a plurality of duplicated left signals and a plurality of duplicated right signals;

means for combining a user-defined proportion of at least one of said duplicated left signals with at least one of said duplicated right signals to form a right intermediate output signal;

means for combining a user-defined proportion of at least one of said duplicated right signals with at least one of said duplicated left signals to form a left intermediate output signal;

means for combining at least one of said duplicated left signals with at least one of said duplicated right signals to form an intermediate center image signal;

means for multiplying said intermediate center image signal by a user-defined function; and means for combining said intermediate center image signal with at least one of said right intermediate signal and said left intermediate signal and with at least one other of said duplicated right and duplicated left signals to form said right output signal and said left output signal.

13. A method of processing signals in a stereo system having a left and a right channel, each of said left and right channels having an input signal and an output signal associated therewith, said method comprising the steps of:

reading information corresponding to each of said left and right signals from a source of audio information;

duplicating each of said left and right signals a predetermined number of times to create a plurality of duplicated left signals and a plurality of duplicated right signals;

manipulating at least one of said duplicated left signals with a first user-defined function to form a first left intermediate space signal;

manipulating at least one of said duplicated right signals with a second user-defined function to form a first right intermediate space signal;

combining said first left intermediate space signal with said first right intermediate space signal to form a left space signal;

manipulating at least one of said duplicated right signals with a third user-defined function to form a second right intermediate space signal;

manipulating at least one of said duplicated left signals with a fourth user-defined function to form a second left intermediate space signal;

combining said second right intermediate space signal with said second left intermediate space signal to form a right space signal;

creating a plurality of mono signal components;

multiplying said mono signal components by at least one user-defined function;

combining said mono signal components in user-defined proportions to form a movement signal;

combining said movement signal with at least one of said right intermediate signal and said left intermediate signal to form said right output signal and said left output signal;

combining at least one of said duplicated left signals with at least one of said duplicated right signals to form an intermediate center image signal;

multiplying said intermediate center image signal by a user-defined function; and combining said intermediate center image signal with said intermediate movement signal, said left space signal and said right space signal to form said right output signal and said left output signal.

14. The method of processing signals of claim 13, further comprising the step of delaying at least one of said duplicated left signals with respect to at least one of said duplicated right signals.

15. The method of processing signals of claim 14 wherein the delay between the at least one of said duplicated left signals and the at least one of said duplicated right signals is in the microsecond range.

16. The method of processing signals of claim 14 wherein the delay between the at least one of said duplicated left signals and the at least one of said duplicated right signals is in the range of 10 microseconds and 1000 microseconds.

17. The method of processing signals of claim 13, further comprising the step of delaying at least one of said duplicated right signals with respect to at least one of said duplicated left signals.

18. The method of processing signals of claim 17 wherein the delay between the at least one of said duplicated right signals and the at least one of said duplicated left signals is in the microsecond range.

19. The method of processing signals of claim 17 wherein the delay between the at least one of said duplicated right signals and the at least one of said duplicated left signals is in the range of 10 microseconds and 1000 microseconds.

20. The method of claim 13, wherein said left space signal is designated as $L_a$, and is created according to the formula:

$$L_a = L_1 * H_1(W) + R_1 * H_2(W)$$

where $L_1$ corresponds to at least one of said duplicated left signals;

$R_1$ corresponds to at least one of said duplicated right signals;

$H_1(W)$ represents a filter and phase selection filter for in phase signals; and $H_2(W)$ represents a filter and phase selection filter for out of phase signals.

21. The method of claim 13, wherein said right space signal is designated as $R_a$, and is created according to the formula:

$$R_a = R_1 * H_1(W) + L_1 * H_2(W)$$

where $R_1$ corresponds to at least one of said duplicated right signals;

$L_1$ corresponds to at least one of said duplicated left signals;

$H_1(W)$ represents a filter and phase selection filter for in phase signals; and $H_2(W)$ represents a filter and phase selection filter for out of phase signals.

22. A method of processing digital stereo signals in a stereo system having a left and a right channel, each having a signal associated therewith, to produce a center image effect, a movement effect and a space effect, said method comprising the steps of:

reading digital information corresponding to each of said left and right signals from a source of digital information;

duplicating each of said left and right signals a predetermined number of times to create a predetermined number of duplicated signals;

combining at least two of said duplicated signals to form an intermediate center image signal;

processing said intermediate center image signal with at least one user-controllable function to generate a center image signal;

combining at least two of said duplicated signals to form an intermediate movement signal;

processing said intermediate movement signal with at least one user-defined function to generate a movement signal;

manipulating at least one of said duplicated signals with a first user-defined function to form a first intermediate space signal;

manipulating at least one of said duplicated signals with a second user-defined function to form a second intermediate space signal;

combining said first intermediate space signal with said second intermediate space signal to form a space signal; and combining said center image signal, said movement signal and said space signal to produce one of a right output signal and a left output signal.

23. An apparatus for processing signals in a stereo system having a left and a right channel, each of said left and right channels having an input signal and an output signal associated therewith, comprising:

means for reading information corresponding to each of said left and right signals from a source of audio information;

means for duplicating each of said left and right signals a predetermined number of times to create a plurality of duplicated left signals and a plurality of duplicated right signals;

means for combining a user-defined proportion of at least one of said duplicated left signals with at least one of said duplicated right signals to form a right intermediate output signal;

means for combining a user-defined proportion of at least one of said duplicated right signals with at least one of said duplicated left signals to form a left intermediate output signal;

means for creating a plurality of mono signal components;

means for multiplying said mono signal components by at least one user-defined function;

means for combining said mono signal components in user-defined proportions to form a movement signal; and means for combining said movement signal with at least one of said right intermediate signal and said left intermediate signal and with at least one other of said duplicated right and duplicated left signals to form said right output signal and said left output signal.

24. The apparatus for processing signals of claim 23, further comprising means for manipulating said at least one other of said duplicated signals with a third user-defined function.

25. The apparatus for processing signals of claim 23, further comprising means for delaying at least one of said duplicated left signals with respect to at least one of said duplicated right signals.

26. The apparatus for processing signals of claim 25 wherein the delay between the at least one of said duplicated left signals and the at least one of said duplicated right signals is in the microsecond range.

27. The apparatus for processing signals of claim 25 wherein the delay between the at least one of said duplicated left signals and the at least one of said duplicated right signals is in the range of 10 microseconds and 1000 microseconds.

28. The apparatus for processing signals of claim 23, further comprising means for delaying at least one of said duplicated right signals with respect to at least one of said duplicated left signals.

29. The apparatus for processing signals of claim 28 wherein the delay between the at least one of said duplicated right signals and the at least one of said duplicated left signals is in the microsecond range.

30. The apparatus for processing signals of claim 28 wherein the delay between the at least one of said duplicated right signals and the at least one of said duplicated left signals is in the range of 10 microseconds and 1000 microseconds.

* * * * *